US011933154B2

(12) United States Patent
Gullickson et al.

(10) Patent No.: US 11,933,154 B2
(45) Date of Patent: Mar. 19, 2024

(54) HIGH-PRESSURE MANIFOLD FOR WELL STIMULATION MATERIAL DELIVERY

(71) Applicant: Halliburton Energy Services, Inc., Houston, TX (US)

(72) Inventors: Geoffrey Wedell Gullickson, Denver, CO (US); John Dean Stabenau, Littleton, CO (US); Jon Preston Doucette, Arvada, CO (US); William Owen Alexander Ruhle, Denver, CO (US); Richard David Grisinger, Greenwood Village, CO (US)

(73) Assignee: Halliburton Energy Services, Inc., Houston, TX (US)

( * ) Notice: Subject to any disclaimer, the term of this patent is extended or adjusted under 35 U.S.C. 154(b) by 410 days.

(21) Appl. No.: 17/290,940

(22) PCT Filed: Dec. 10, 2018

(86) PCT No.: PCT/US2018/064661
§ 371 (c)(1),
(2) Date: May 3, 2021

(87) PCT Pub. No.: WO2020/122854
PCT Pub. Date: Jun. 18, 2020

(65) Prior Publication Data

US 2021/0372255 A1 Dec. 2, 2021

(51) Int. Cl.
*E21B 43/26* (2006.01)

(52) U.S. Cl.
CPC ..... *E21B 43/2607* (2020.05)

(58) Field of Classification Search
CPC ..... E21B 43/26
See application file for complete search history.

(56) References Cited

U.S. PATENT DOCUMENTS 5,589,603 A * 12/1996 Alexander ..... B09B 1/008 166/305.1
5,899,272 A * 5/1999 Loree ..... E21B 43/26 166/280.2

(Continued)

FOREIGN PATENT DOCUMENTS

KR 10-2014-0030176 A 3/2014
WO 2017/135835 A1 8/2017

OTHER PUBLICATIONS

McCartney, E.S., and R. L. Kennedy. "A family of unique diverting techniques increases uncoventional production and recovery in multiple applications-initial fracturing, refracturing, and acidizing." SPE Hydraulic Fracturing Technology Conference. OnePetro, 2016.

(Continued)

*Primary Examiner* — Dany E Akakpo
(74) *Attorney, Agent, or Firm* — Kilpatrick Townsend & Stockton LLP

(57) ABSTRACT

Methods and systems for delivering well stimulation materials to a wellbore using a high-pressure delivery manifold are provided. In some embodiments, the methods of the present disclosure include: providing a pressurizable delivery manifold at a well site, wherein the pressurizable delivery manifold is continuously equalized with a piping system; providing a pressurized treatment fluid to the pressurizable delivery manifold; releasing one or more well stimulation materials into the pressurized treatment fluid to create a payload delivery treatment fluid; and injecting the payload delivery treatment fluid into at least a portion of a subterranean formation.

19 Claims, 3 Drawing Sheets

(56) References Cited

U.S. PATENT DOCUMENTS

| | | | |
|---|---|---|---|
| 6,575,247 | B2 | 6/2003 | Tolman et al. |
| 8,905,133 | B2 | 12/2014 | Potapenko et al. |
| 9,145,766 | B2 | 9/2015 | Fripp et al. |
| 2010/0243251 | A1 | 9/2010 | Luharuka et al. |
| 2011/0011583 | A1 | 1/2011 | Niconoff |
| 2011/0237465 | A1 | 9/2011 | Lee et al. |
| 2012/0271011 | A1 | 8/2012 | Dotson et al. |
| 2012/0285695 | A1 | 11/2012 | Lafferty et al. |
| 2015/0041132 | A1 | 2/2015 | Nelson et al. |
| 2017/0350244 | A1 | 12/2017 | Hall et al. |

OTHER PUBLICATIONS

Gomaa, Ahmed M., et al. "Engineering solid particulate diverter to control fracture complexity: Experimental Study." SPE Hydraulic Fracturing Technology Conference. OnePetro, 2016.

International Search Report and Written Opinion issued in related PCT Application No. PCT/US2018/064661 dated Sep. 10, 2019, 13 pages.

International Preliminary Report on Patentability issued in related PCT Application No. PCT/US2018/064661, dated Jun. 24, 2021, 10 pages.

* cited by examiner

HIGH-PRESSURE MANIFOLD FOR WELL STIMULATION MATERIAL DELIVERY

CROSS-REFERENCE TO RELATED APPLICATION

The present application is a U.S. National Stage Application of International Application No. PCT/US2018/064661 filed Dec. 10, 2018, which is incorporated herein by reference in its entirety for all purposes.

BACKGROUND

The present disclosure relates generally to techniques for fracturing subterranean formations, and more particularly, to the use of a pressurizable manifold system for well stimulation material delivery during fracturing operations.

Subterranean treatment fluids are commonly used in stimulation, sand control, and completion operations. As used herein, the term "treatment," or "treating," refers to any subterranean operation that uses a fluid in conjunction with a desired function and/or for a desired purpose. The term "treatment," or "treating," does not imply any particular action by the fluid.

An example of a subterranean treatment that often uses an aqueous treatment fluid is hydraulic fracturing. In an example hydraulic fracturing treatment, a fracturing fluid is introduced into the formation at a high enough rate to exert sufficient pressure on the formation to create and/or extend fractures therein. The fracturing fluid may suspend proppant particles that are to be placed in the fractures to prevent the fractures from fully closing when hydraulic pressure is released, thereby forming conductive channels within the formation through which hydrocarbons can flow toward the wellbore for production. In certain circumstances, variations in the subterranean formation may cause the fracturing fluid to create and/or extend fractures non-uniformly.

One or more dominant fractures may extend more rapidly than non-dominant fractures. These dominant fractures may utilize significantly more fracturing fluid than non-dominant fractures, thereby reducing pressure on non-dominant fractures and slowing or stopping their extension. Some stimulation processes have addressed the unbalanced distribution of fracture fluid by introducing a certain quantity of diverters into the fracturing fluid when dominant fractures are identified. The diverters may travel to the dominant fractures and restrict the flow of fracturing fluid to the dominant fractures or plug the dominant fractures. These diverter processes may be alternated with proppant fracturing treatments to achieve maximum subterranean stimulation. In addition to proppant and diverter materials, many other additives and materials are often injected into the well during hydraulic fracturing treatment operations. Managing the delivery of these various components is a complex task that requires significant resources located at a well site.

BRIEF DESCRIPTION OF THE DRAWINGS

Some specific exemplary embodiments of the disclosure may be understood by referring, in part, to the following description and the accompanying drawings.

Figure 1:
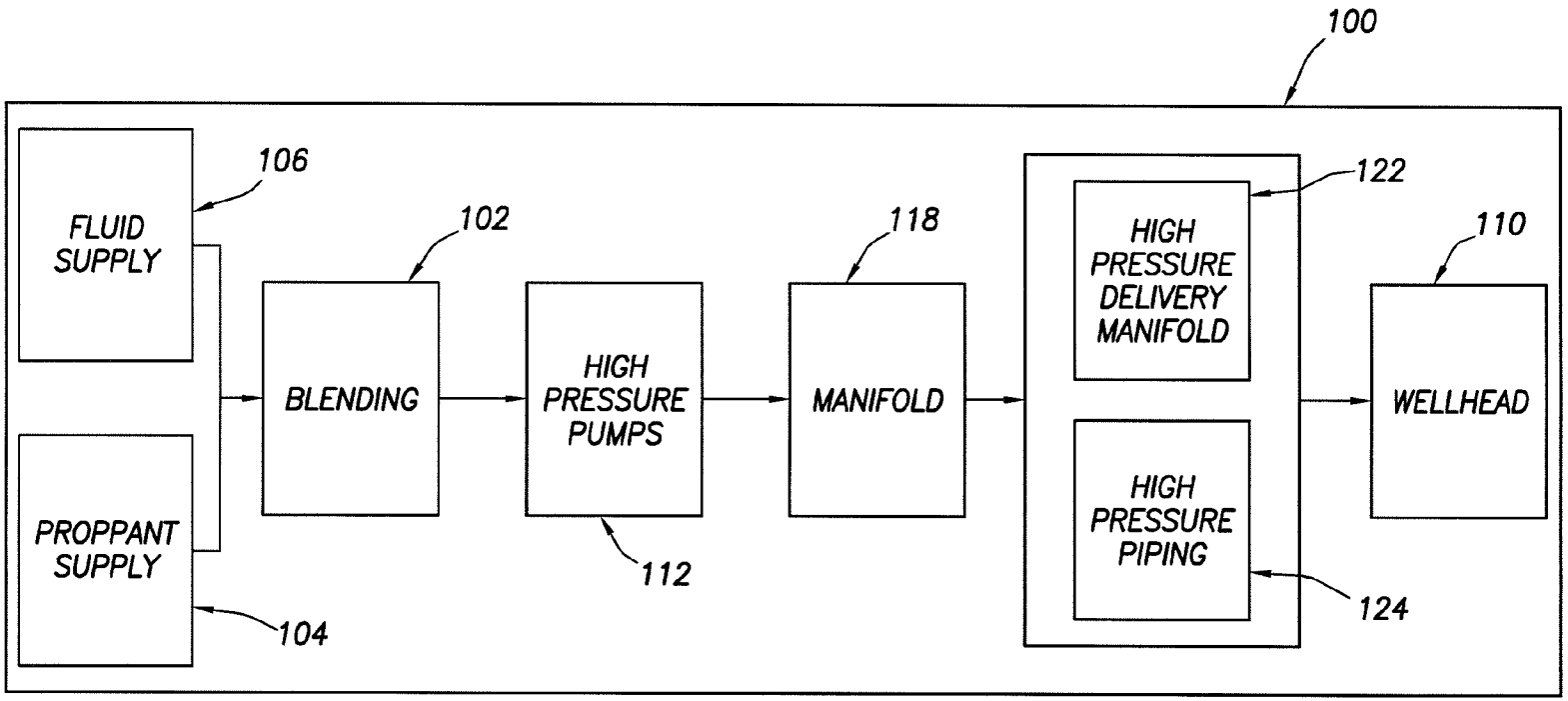
FIG. 1 is a schematic representation an example of a well stimulation material delivery system that may be used in accordance with certain embodiments of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to techniques for fracturing subterranean formations, and more particularly, to the use of a pressurizable manifold system for well stimulation material delivery during fracturing operations.

Illustrative embodiments of the present disclosure are described in detail herein. In the interest of clarity, not all features of an actual implementation may be described in this specification. It will of course be appreciated that in the development of any such actual embodiment, numerous implementation specific decisions are made to achieve the specific implementation goals, which will vary from one implementation to another. Moreover, it will be appreciated that such a development effort might be complex and time-consuming but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, or otherwise nonlinear wellbores in any type of subterranean formation. Embodiments may be applicable to injection wells as well as production wells, including hydrocarbon wells.

Production of oil and gas from subterranean formations presents many challenges. One such challenge is the lack of permeability in certain formations. Often oil or gas bearing formations, that may contain large quantities of oil or gas, do not produce at a desirable production rate due to low permeability; the low permeability causing an uneconomical flow rate of the sought-after hydrocarbons. To increase the flow rate, a stimulation treatment can be performed. One such stimulation treatment is hydraulic fracturing. Hydraulic fracturing is a process whereby a subterranean hydrocarbon reservoir may be stimulated to form conductive channels within the formation, increasing the flow of hydrocarbons from the reservoir. During a hydraulic fracturing operation, a treatment fluid known as a fracturing fluid may be pumped at high-pressure conditions, e.g., in excess of 1,000 psi, to crack the formation thereby creating larger passageways for hydrocarbon flow. Other stimulation treatments may include matrix acidizing, acid fracturing, and sand control operations.

While the high pressure introduced into the subterranean formation may produce cracks in said formation, the reduction of the pressure back to normal borehole pressures often causes the closing of the cracks much in the manner that a crack wedged open in a piece of wood may close when the wedge used to produce the crack is removed. Such closing of the cracks produced by the hydraulic fracturing operating may be undesirable. To avoid the closing of reservoir cracks when the hydraulic pressure is lowered, the fracturing fluid may have proppants added thereto, such as sand or other solids that are placed within the cracks in the formation, so that, at the conclusion of the fracturing treatment, when the high-pressure is released, the cracks may remain at least partially propped open, thereby permitting the increased hydrocarbon flow possible through the produced cracks to continue into the wellbore.

In order to pump the fracturing fluid into the well, some wellbore stimulation treatment operations may employ any variety of positive displacement or other fluid delivering pumps. A positive displacement pump may be a fairly large piece of equipment with associated engine, transmission, crankshaft and other parts, operating at between about 200 HP and about 4,000 HP. A large plunger is driven by the crankshaft toward and away from a chamber in the pump to affect pressure. This makes a positive displacement pump a good choice for high-pressure applications. Hydraulic fracturing of underground rock, for example, may occur at pressures between 1,000 to 20,000 PSI or more.

While the term "fracturing" as used herein may refer to conventional fracturing operations, it also may include frac pack operations, fracture acidizing operations, or any of a number of other treatments, comprising fracturing. Additionally, the methods of this disclosure may be used for subterranean operations other than fracturing that involve the use of pressurized fluids.

Some methods for delivery of well stimulation materials to a wellbore may relate to bulk delivery of a material to the wellsite. The well stimulation materials may be metered into a blender using control systems to manage the addition of the material to create a low-pressure slurry. The slurry may then be pressurized via one or more high-pressure pumps to be injected into the well. However, this process may not accommodate all materials or treatment operation needs. Additionally, this approach may be unworkable for delivery of materials comprising a relatively large diameter that may damage the high-pressure pumps and supporting equipment.

The present disclosure provides systems and methods for delivering a discrete amount of well stimulation materials in a manner that may be controlled with greater accuracy, traceability, and formation response than certain conventional methods. Accordingly, the systems and methods of the present disclosure may be suitable for use with a wider range of materials. In particular, the present disclosure provides systems and methods for using pressurizable surface manifold equipment that can deliver single or multiple discrete payloads of stimulation material to a high-pressure treatment stream. In some embodiments, no additional blending or high-pressure pumping equipment or accessories not already utilized in well stimulation operations may be required. In certain embodiments, the pressurizable surface delivery manifold may be utilized to deliver any type of stimulation material that may otherwise require blending and pressurization as long as the well stimulation material does not exceed the volumetric capacity of the pressurizable delivery manifold. In some embodiments, the pressurizable delivery manifold may be stress rated to a mechanical competence required for the well stimulation process in certain instances. In particular, in certain embodiments, the pressurizable delivery manifold may be continuously pressure-equalized with all high-pressure piping and associated equipment between the wellhead and the discharge side of the high-pressure pumps. Accordingly, the pressurizable delivery manifold cannot trap pressure therein relative to the rest of the high-pressure piping and associated equipment. Accordingly, the pressurizable delivery manifold may also be commonly depressurized along with all other high-pressure piping and associated equipment.

In one or more embodiments, a well treatment operations facility may comprise any combination of a power source, a proppant storage system, a chemical or fluid storage system, a blending system, and a manifold comprising a pumping system. Connections within and outside of the well treatment operations facility may include conduit comprising standard piping or tubing known to one of ordinary skill in the art. In some embodiments, the pumping system may comprise one or more high-pressure pumps, positive displacement pumps, centrifugal pumps, or other pumps for one or more of distributing fluid within the centralized well treatment facility and pumping one or more treatment fluids to one or more wells.

In one or more embodiments, the blending system may comprise a blender for producing a fluid from a wide variety of materials including base fluids and solids. Those of ordinary skill in the art having the benefit of the present disclosure will appreciate that the terms "treatment fluid" and "well stimulation fluid" as used in the present disclosure may refer to a mixture of one or more substantially solids-free fluids or they may be a slurry comprising one or more base fluids and one or more solids disclosed herein that may be used in accordance with the methods and systems of the present disclosure. In an example embodiment, a slurry may comprise one or more of water, well-stimulation fluid, cement, gelling agents, breakers, surfactants, crosslinkers, gelling agents, viscosity altering chemicals, pH buffers, modifiers, surfactants, breakers, and stabilizers, as well as friction reducers, viscosifiers, diverting agents, and diverting material.

In one or more embodiments, the centralized well treatment operations facility may produce treatment fluids comprising one or more of base fluids, slurries, and solids. Examples of such treatment fluids include, but are not limited to, drill-in fluids, drilling fluids, completion fluids, workover fluids, fracturing fluids, and the like. In certain embodiments, the treatment fluids used in the methods and systems of the present disclosure may include any base fluid known in the art, including aqueous base fluids, non-aqueous base fluids, and any combinations thereof. The term "base fluid" refers to the major component of the fluid (as opposed to components dissolved and/or suspended therein) and does not indicate any particular condition or property of that fluids such as its mass, amount, pH, etc. Examples of non-aqueous fluids that may be suitable for use in the methods and systems of the present disclosure include, but are not limited to, oils, hydrocarbons, organic liquids, and the like.

Aqueous base fluids that may be suitable for use in the systems and methods of the present disclosure may include water from any source. In certain embodiments, the aqueous base fluids used in the methods and systems of the present disclosure may include fresh water, salt water (e.g., water containing one or more salts dissolved therein), brine (e.g., saturated salt water), seawater, or any combination thereof. In some embodiments, the aqueous base fluids may include one or more ionic species, such as those formed by salts dissolved in water. The ionic species may be any suitable ionic species known in the art. In certain embodiments, the density of the aqueous base fluid may be adjusted, among other purposes, to provide additional particulate transport and suspension. In certain embodiments, the pH of the aqueous base fluid may be adjusted (e.g., by a buffer or other pH adjusting agent) to a specific level, which may depend, among other factors, on the types of clays, acids, and other additives included in the fluid. In some embodiments, the base fluid may be mixed with a compressed gas, including but not limited to nitrogen and carbon dioxide.

The methods and systems of the present disclosure may use any treatment fluid suitable for a fracturing, gravel packing, or frac-packing application, including aqueous gels, viscoelastic surfactant gels, oil gels, foamed gels, and emulsions. Suitable aqueous gels may comprise water and one or more gelling agents. Suitable emulsions can be comprised of two immiscible liquids such as an aqueous liquid or gelled liquid and a hydrocarbon. In certain embodiments, the addition of a gas, such as carbon dioxide or nitrogen may create foams. In some embodiments of the present disclosure, the fracturing fluids may be aqueous gels comprised of water, a friction reducer to affect its rheological properties including viscosity, a gelling agent for gelling the water and increasing its viscosity, and, optionally, a crosslinking agent for crosslinking the gel and further increasing the viscosity of the fluid. The rheological properties of the fluid may enhance the fluid's transport characteristics and allow the fracturing fluid to convey significant quantities of suspended proppant particles. The water used to form the treatment fluid may be fresh water, salt water, brine, seawater, or any other aqueous liquid that does not adversely react with the other components. The density of the water can increase to provide additional particle transport and suspension in the present disclosure.

In certain embodiments, the gelling agents may include hydratable polymers that contain one or more functional groups such as hydroxyl, carboxyl, sulfate, sulfonate, amino, or amide groups. Suitable gelling agents may comprise polymers, synthetic polymers, or a combination thereof. A variety of suitable gelling agents for use in conjunction with the methods and systems of the present disclosure, include, but are not limited to, hydratable polymers that contain one or more functional groups such as hydroxyl, cis-hydroxyl, carboxylic acids, and derivatives of carboxylic acids, sulfate, sulfonate, phosphate, phosphonate, amino, or amide. In certain embodiments, the gelling agents may be polymers comprising polysaccharides, and derivatives thereof that contain one or more of these monosaccharide units: galactose, mannose, glucoside, glucose, xylose, arabinose, fructose, glucuronic acid, or pyranosyl sulfate. Examples of suitable polymers include, but are not limited to, guar gum and derivatives thereof, such as hydroxypropyl guar and carboxymethylhydroxypropyl guar, and cellulose derivatives, such as hydroxyethyl cellulose. Additionally, synthetic polymers and copolymers that contain the above-mentioned functional groups may be used. Examples of such synthetic polymers include, but are not limited to, polyacrylate, polymethacrylate, polyacrylamide, polyvinyl alcohol, and polyvinylpyrrolidone. In other embodiments, the gelling agent molecule may be depolymerized. The term "depolymerized," as used herein, refers to a decrease in the molecular weight of the gelling agent molecule. Suitable gelling agents may be present in the viscosified treatment fluids used in methods and systems of the present disclosure in an amount in the range of from about 0.1% to about 5% by weight of the water therein. In certain embodiments, the gelling agents may be present in the viscosified treatment fluids used in the methods and systems of the present disclosure in an amount in the range of from about 0.01% to about 2% by weight of the water therein.

Crosslinking agents may be used to crosslink gelling agent molecules to form crosslinked gelling agents. Crosslinkers may comprise at least one ion that is capable of crosslinking at least two gelling agent molecules. Examples of suitable crosslinkers include, but are not limited to, boric acid, disodium octaborate tetrahydrate, sodium diborate, pentaborates, ulexite and colemanite, compounds that can supply zirconium 1V ions (such as, for example, zirconium lactate, zirconium lactate triethanolamine, zirconium carbonate, zirconium acetylacetonate, zirconium malate, zirconium citrate, and zirconium diisopropylamine lactate); compounds that can supply titanium IV ions (such as, for example, titanium lactate, titanium malate, titanium citrate, titanium ammonium lactate, titanium triethanolamine, and titanium acetylacetonate); aluminum compounds (such as, for example, aluminum lactate or aluminum citrate); antimony compounds; chromium compounds; iron compounds; copper compounds; zinc compounds; or a combination thereof. Suitable crosslinkers may be present in the viscosified treatment fluids used in the methods and systems of the present disclosure in an amount sufficient to provide the desired degree of crosslinking between gelling agent molecules. In certain embodiments of the present disclosure, the crosslinkers may be present in an amount in the range from about 0.001% to about 10% by weight of the water in the treatment fluid. In certain embodiments of the present disclosure, the crosslinkers may be present in the treatment fluids in an amount in the range from about 0.01% to about 1% by weight of the water therein. Individuals skilled in the art, with the benefit of this disclosure, will recognize the exact type and amount of crosslinker to use depending on factors such as the specific gelling agent, desired viscosity, and formation conditions.

The gelled or gelled and cross-linked treatment fluids may also include internal delayed gel breakers such as enzyme, oxidizing, acid buffer, or temperature-activated gel breakers. The gel breakers cause the viscous treatment fluids to revert to thin fluids for production back to the surface after use to place proppant particles in subterranean fractures. The gel breaker used is typically present in the treatment fluid in an amount in the range of from about 0.5% to about 10% by weight of the gelling agent. The treatment fluids may also include one or more of a variety of well-known additives, such as gel stabilizers, fluid loss control additives, clay stabilizers, bactericides, and the like.

FIG. 1 illustrates a centralized well treatment facility 100 for treating a well in accordance with certain embodiments of the present disclosure. In one or more embodiments, centralized well treatment facility 100 may include a blending system comprising blender 102, proppant storage system 104, fluid storage system 106, one or more high-pressure pumps 112, manifold 118 for delivering treatment fluid to well 110, and a power source (not shown). Blender 102 may combine proppant from proppant storage system 104 with fluid from fluid storage system 106 to produce a slurry. Note that for the purposes of describing this figure, the fluid produced by blender 102 is referred to as a slurry but may be any combination of one or more base fluids and/or solids as described herein. The blender 102 may feed clean fluid or proppant laden slurry to high-pressure pumps 112. In certain embodiments, blender 102 may further comprise a booster pump (not shown). In some embodiments, the discharge of high-pressure pumps 112 may feed high-pressure clean fluid or proppant laden slurry to pressurizable delivery manifold 122 via high-pressure piping 124 connected in a parallel fluid circuit. Additionally, in some embodiments, high-pressure piping 124 then may convey the pressurized fluid to well 110. Alternatively, in other embodiments, the clean fluid or proppant laden slurry may bypass pressurizable delivery manifold 122 using bypass equipment within high-pressure piping 124. Note that each element depicted in the system may comprise one or more of each element shown. For example, each pump described herein may comprise one or more pumps, each blender may comprise one or more blenders, and the storage systems may comprise one or more tanks or containers for storing material. Further, as described herein, each blender or blending system may further comprise one or more boost pumps. Additionally, the power source of the well treatment operations facility may be one or more power sources, and these sources may be electric, gas, diesel, or natural gas powered, or any combination thereof.

In one or more embodiments, pressurizable delivery manifold 122 may be used to deliver single or multiple discrete payloads of stimulation materials to well 110. In certain embodiments, the stimulation materials may include any type of stimulation material that would otherwise require blending and pressurization as long as the volume of the well stimulation material does not exceed the volumetric capacity of the pressurizable delivery manifold 122. For example, in some embodiments, the stimulation materials may include natural sand; manmade proppants; manmade ceramic, sintered bauxite, and processed solids; diverting agents; flow constraint additives surfactants; penetrating agents; solvents; formation mobility modifiers; polymer breakers; acids; bases; crosslinkers; biocides; fibrous materials; viscosity additives; friction reducers; and any combination thereof. In one or more embodiments, the stimulation materials may include basalt (trap rock) aggregate, polylactic acid, polylactide resin, polyvinyl alcohol, calcium carbonate, benzoic acid flakes, crushed oyster shells, fibrous materials, solids ranging from about 40 microns to about 6 inches in diameter, and any combinations of the above.

In certain embodiments, the centralized well treatment facility may further comprise a local control system (not shown) including one or more controllers, wherein each of the controllers may comprise hardware and software. In certain embodiments, controllers may comprise consumer off-the-shelf ("COTS") computer systems, including hardware and software. In some embodiments, controllers may further comprise specialized hardware and software. In some embodiments, controllers may comprise specialized hardware and software for communicating with one or more of sensors, pumps, blenders, storage systems, valves, and other elements of the centralized well treatment facility to monitor (including, but not limited to, detecting and recording data) and control (including, but not limited to, regulating, managing, and directing) one or more of the production and flow of one or more treatment fluids for treatment of one or more wells, either independently, simultaneously, or both. In certain embodiments, controllers may automatically monitor and control the treatment of one or more wells based at least in part on one or more of a reservoir model, a hydraulic fracture model, and programmed fracturing stages. In some embodiments, controllers may display or otherwise notify users, including for example, operations personnel such as an operator in a control van regarding the controller's monitoring and controlling one or more of the production and flow of one or more treatment fluids and solids for treating one or more wells. In certain embodiments, controllers may receive one or more inputs from personnel to monitor and control one or more of the production and flow of one or more treatment fluids for treating of one or more wells, either independently, simultaneously, or both. In some embodiments, treatment fluid may be distributed to one or more wells 110.

Figure 2:
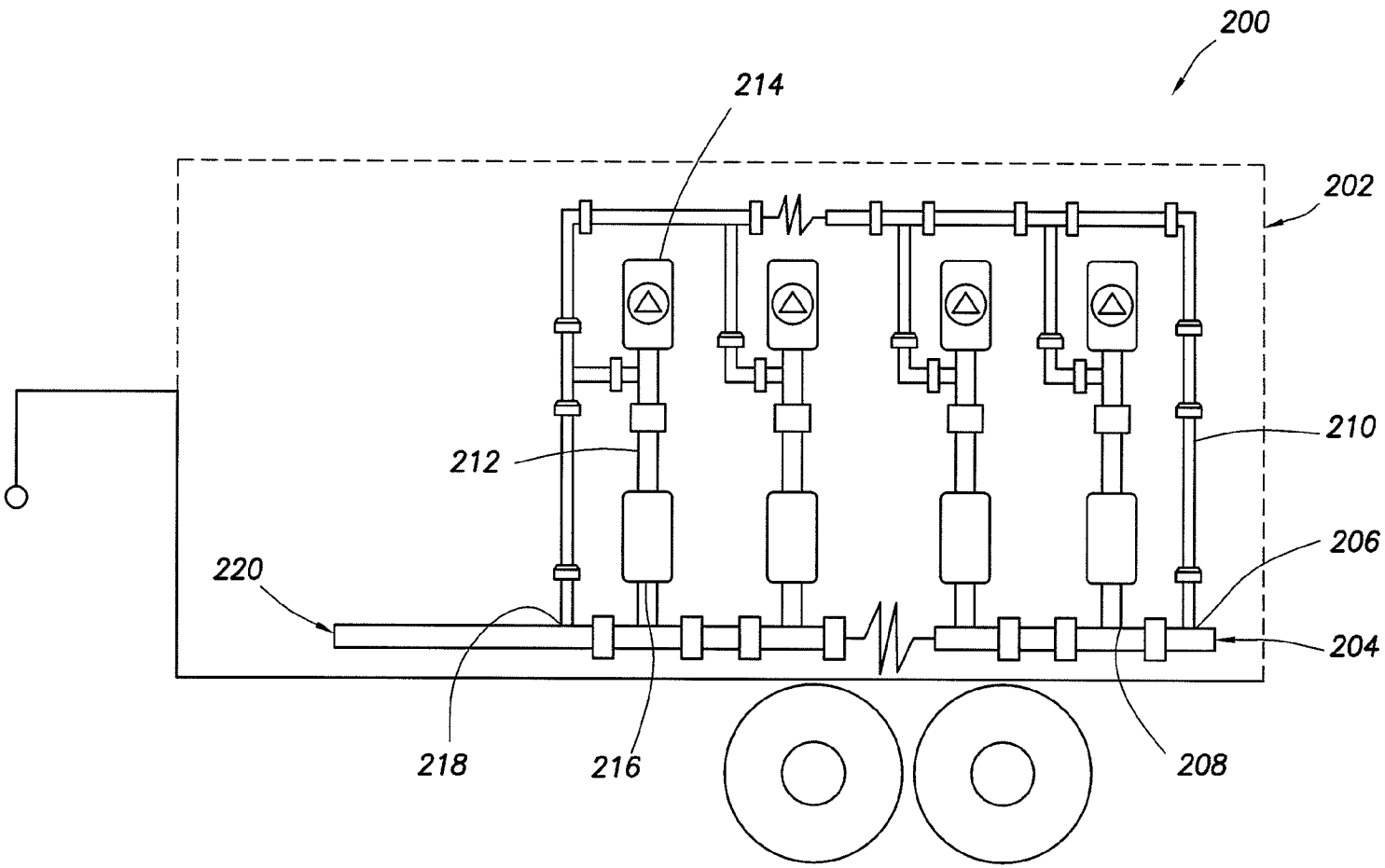
FIG. 2 is a schematic representation an example of a pressurizable delivery manifold that may be used in accordance with certain embodiments of the present disclosure.

FIG. 2 illustrates a pressurizable delivery manifold 200 in accordance with one or more embodiments of the present disclosure. In some embodiments, pressurizable delivery manifold 200 may be mounted on equipment trailer 202. In other embodiments, pressurizable delivery manifold 200 may be mounted on a mobile skid (not shown) or other suitable vehicles or equipment. In other embodiments, pressurizable delivery manifold 200 may be contained within equipment trailer 202. In certain embodiments, pressurizable delivery manifold 200 may be manufactured out of any material suitable for high-pressure treatment operations involving treatment fluids and chemicals. For example, in some embodiments, pressurizable delivery manifold 200 may be manufactured using common treating iron elements and equipment. In one or more embodiments, fluid inlet 204 may receive clean fluid or proppant laden slurry from one or more high-pressure pumps (not shown in this figure). In certain embodiments, first piping tee 206 splits the clean fluid or proppant laden slurry flow into manifold treatment line 208 and equalization line 210. In some embodiments, pressurizable delivery manifold 200 may comprise one or more pressure chambers 212. In certain embodiments, pressurizable delivery manifold 200 may comprise at least two pressure chambers 212. In other embodiments, pressurizable delivery manifold 200 may comprise at least eight pressure chambers 212. In certain embodiments, each pressure chamber 212 may be coupled to plug 214. In some embodiments, plug 214 may be a manual plug valve. In other embodiments, plug valve 214 may be a bull plug. In one or more embodiments, plug 214 may be disposed directly above pressure chamber 212 to facilitate gravity feeding of payload materials. In one or more embodiments, plug 214 comprises a ¼ turn direct drive valve or threaded bull plug. In operation, plug 214 may be opened while the system is depressurized to load the payload materials into pressure chamber 212. In some embodiments, each plug 214 may be closed prior to pressurizing the system for treatment operations.

In one or more embodiments, pressurizable delivery manifold 200 may additionally comprise one or more remote plug valves 216. Each remote plug valve 216 may be coupled to a corresponding pressure chamber 212 and may be disposed directly beneath the corresponding pressure chamber 212. In certain embodiments, remote operated valves may be electrically, hydraulically, or pneumatically actuated from a remote power source. Accordingly, an operator may remotely actuate each remote plug valve 216 during operation to release the discrete well stimulation material into manifold treatment line 208. In some embodiments, second piping tee 218 may provide a common equalization connection for manifold treatment line 208 and equalization line 210. In certain embodiments, first piping tee 206 and second piping tee 218 may provide continuous pressure communication between manifold treatment line 208, equalization line 210, and the one or more pressure chambers 212. Accordingly, the internals of pressurizable delivery manifold 200 may be continuously pressure-equalized, thereby facilitating valve actuation and preventing the potential for trapped energy within the system. In certain embodiments, pressurizable delivery manifold 200 may additionally comprise fluid outlet 220 that delivers fluid to the well (not shown in this figure).

Figure 3:
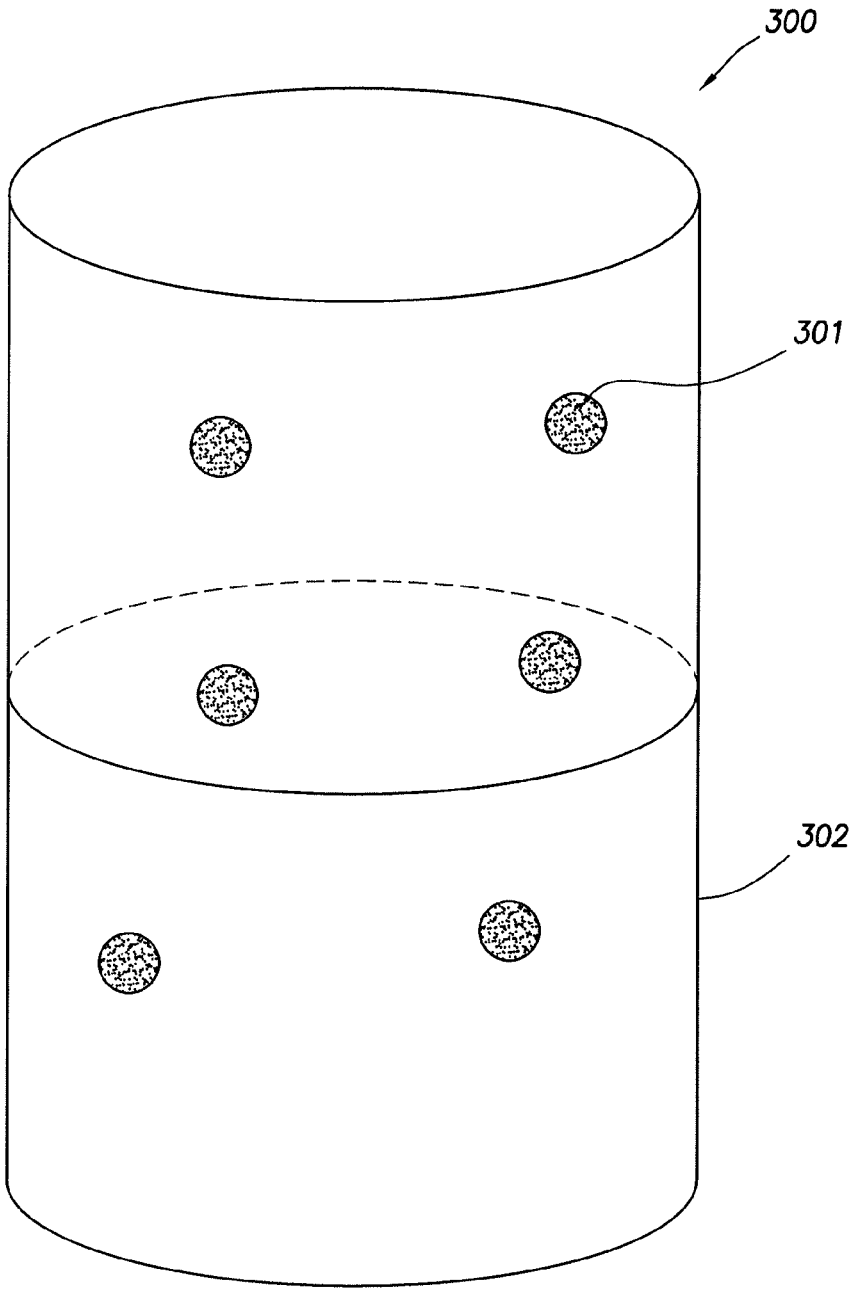
FIG. 3 is a schematic representation an example of a well stimulation material pill that may be used in accordance with certain embodiments of the present disclosure.

As discussed above, pressurizable delivery manifold may be used to deliver discrete payloads into the well. In some embodiments, these discrete payloads may be unpackaged stimulation materials physically measured and metered into the one or more pressure chamber(s) 212. In other embodiments, these discrete payloads may be contained in a degradable packaging dose, e.g. a pill. In FIG. 3, an illustration depicting a payload material pill 300 is shown. In certain embodiments, well stimulation material particles 301 may be fully encapsulated by packaging 302. In some embodiment, within each packaging 302, there may be any number of stimulation material particles or material forms 301. In certain embodiments, packaging 302 may comprise any material that will degrade by means of melting, dissolution, stress-induced cracking or rupture, erosion, disintegration, or otherwise expose the material 301 contained within packaging 302 to the wellbore. In some embodiments, packaging 302 may comprise one or more of the following materials: polyacrylamide (PA); polyacrylamide copolymers; polylactic acid (PLA); polyglycolic acid (PGA) polyvinyl alcohol (PVOH); a polyvinyl alcohol copolymer; a methyl methacrylate; an acrylic acid copolymer; natural latex; or any combination of one or more of these materials. In one or more embodiments, packaging 302 may be selected based on the materials stability and degradation characteristics for different polar solvency environments. In certain embodiments, packaging 302 may be polyvinyl alcohol. Polyvinyl alcohol may degrade rapidly when contacted with water, such as found in common aqueous based treatment fluids. In one or more embodiments, packaging 302 may fully degrade prior to the opening of the one or more remote plug valves. In some embodiments, stimulation material particles 301 may rest on top of the remote plug valve. Once the remote plug valve is actuated, the stimulation material particles 301 may be mixed with the high-pressure clean fluid prior to delivery to the well. In other embodiments, the packaging 302 may fully degrade prior to entering the well. In some embodiments, stimulation material particles 301 may be released into the high-pressure clean fluid while travelling from the pressurizable delivery manifold to the well. In certain embodiments, pill 300 comprises a generally cylindrical shape. In the embodiments where the pill 300 comprises a cylindrical shape, the diameter may be less than about 4 inches and the height may be in the range of from about 5 inches to about 12 inches.

In certain embodiments, packaging 302 may comprise any material that will degrade by means of melting, dissolution, stress-induced cracking or rupture, erosion, or disintegration when exposed to a chemical solution, a chemical reaction, an ultraviolet light, a nuclear source, mechanical impact or abrasion, or a combination thereof. In some embodiments, these components may be formed of any degradable material that is suitable for service in a downhole environment and that provides adequate strength to encapsulate and protect stimulation material particles 301. By way of example only, one such material is an epoxy resin that dissolves when exposed to a caustic fluid. Another such material is a fiberglass that dissolves when exposed to an oxidizing acidic or strong alkaline solution. Still another such material is a binding agent, such as an epoxy resin, for example, with glass reinforcement that dissolves when exposed to a chemical solution of caustic fluid or acidic fluid. Still another example is a composition comprising a mixture of sinter metals including an alkali metal or alkaline earth metal that may dissolve in response to temperature and salinity. Any of these exemplary materials could also degrade when exposed to an ultraviolet light or a nuclear source. Thus, the materials used to form packaging 302 may degrade by one or more of dissolving, breaking down, eroding, or disintegrating from exposure to certain conditions (e.g., pH, temperature, salinity, pressure gradient, and pressure), a chemical solution, a chemical reaction, or from exposure to an ultraviolet light or a nuclear source, or by a combination thereof. The particular material matrix used to form the dissolvable components of the packaging 302 may be customizable for operation within particular pH, pressure, pressure gradient, and temperature ranges, or to control the dissolution rate of dissolution of the packaging 302 when exposed to these conditions, a chemical solution, an ultraviolet light, a nuclear source, or a combination thereof.

During operations, in certain embodiments, the methods of the present disclosure may comprise installing the pressurizable delivery manifold equipment trailer at a well site. In some embodiments, the pressurizable delivery manifold may be connected to the outlet of one or more high-pressure pumps prior to pressurization of the system. The entire system may then be filled with fluids, including the pressurizable delivery manifold. In some embodiments, operators at the well site may then load one or more well stimulation material quantities or pills into the pressurizable delivery manifold. In one or more embodiments, the operators may load the well stimulation material quantities or pills by manually opening the plugs and loading the payload material quantity or pills into the one or more pressure chambers. In some embodiments, the well stimulation material quantities or pills may contain the same stimulation materials. In other embodiments, the well stimulation material quantities or pills may contain different stimulation materials. The operators may then close the manual plug valves or bull plugs. In certain embodiments, the entire treatment system may be pressure tested according to standard operating procedures either before or after loading the payload material quantity or pills.

Once the system has been pressure tested, normal treatment operations may begin. Traditional fracturing or treatment operations may occur according to the standard procedures. In some embodiments, the one or more high-pressure pumps at the wellsite may be used to inject traditional proppant and/or stimulation material streams into the well. Likewise, in one or more embodiments, dirty streams may be alternated with clean injection streams from the one or more high-pressure pumps without any use of the pressurizable delivery manifold. As discussed above, at the time when it is desired to inject one or more of the payload material pills into the well, the operators may actuate the remote plug valves to release the discrete stimulation materials.

An embodiment of the present disclosure is a method that includes: providing a pressurizable delivery manifold at a well site, wherein the pressurizable delivery manifold is continuously equalized with a piping system; providing a pressurized treatment fluid to the pressurizable delivery manifold; releasing one or more well stimulation materials into the pressurized treatment fluid to create a payload delivery treatment fluid; and injecting the payload delivery treatment fluid into at least a portion of a subterranean formation.

In one or more embodiments described in the preceding paragraph, the pressurizable delivery manifold includes: a fluid line comprising a fluid inlet and a fluid outlet; an equalization line coupled to the fluid inlet via a first piping tee and coupled to the fluid outlet via a second piping tee; one or more pressure chambers coupled to the equalization line; for each of the one or more pressure chambers, a separate plug coupled to that pressure chamber; and for each of the one or more pressure chambers, a separate remote plug valve coupled to that pressure chamber and coupled to the fluid line. In one or more embodiments described above, the payload delivery treatment fluid includes a slurry. In one or more embodiments described above, the method further includes: loading the one or more well stimulation materials into the pressurizable delivery manifold; and pressurizing the piping system after loading the one or more well stimulation materials. In one or more embodiments described above, the step of loading of the one or more well stimulation materials into the pressurizable delivery manifold further includes operating one or more plugs. In one or more embodiments described above, the step of releasing one or more well stimulation materials into the pressurized treatment fluid to create a payload delivery treatment fluid includes operating one or more remote plug valves. In one or more embodiments described above, the well stimulation material is selected from the group consisting of: natural sand; a manmade proppant, a manmade ceramic, sintered bauxite, a processed solid, a diverting agent, a flow constraint additive, a surfactant, a penetrating agent, a solvent, a formation mobility modifier, a polymer breaker, an acid, a base, a crosslinker, a biocide, a fibrous material, a viscosity additive, a friction reducer, and any combination thereof. In one or more embodiments described above, the well stimulation material is selected from the group consisting of: a basalt (trap rock) aggregate, a polylactic acid, a polylactide resin, or any combination thereof. In one or more embodiments described above, the well stimulation material further includes a plurality of particulates surrounded by a degradable packaging. In one or more embodiments described above, the degradable packaging includes a polyvinyl alcohol. In one or more embodiments described above, the method further includes allowing the degradable packaging to dissolve in the pressurized treatment fluid. In one or more embodiments described above, the one or more well stimulation materials are different. In one or more embodiments described above, the step of releasing one or more well stimulation materials into the pressurized treatment fluid to create a payload delivery treatment fluid includes remotely opening one or more remote plug valves and allowing the well stimulation materials to gravity feed into the pressurized treatment fluid.

Another embodiment of the present disclosure is a system that includes: one or more fluid pumps; a treatment fluid source fluidically coupled to the one or more fluid pumps; a pressurizable delivery manifold fluidically coupled to the one or more fluid pumps, wherein the pressurizable delivery manifold includes: a fluid line comprising a fluid inlet and a fluid outlet; an equalization line coupled to the fluid inlet using a first piping tee and coupled to the fluid outlet using a second piping tee; one or more pressure chambers coupled to the equalization line; for each of the one or more pressure chambers, a separate plug coupled to that pressure chamber; and for each of the one or more pressure chambers, a separate remote plug valve coupled to that pressure chamber and coupled to the fluid line.

In one or more embodiments described in the preceding paragraph, the pressurizable delivery manifold further includes: an equalization line fluidically coupled to the fluid inlet, fluid outlet, and the one or more pressure chambers; and a well bore fluidically coupled to the fluid outlet. In one or more embodiments described above, the system further includes: one or more proppant storage vessels; a blender fluidically coupled to the treatment fluid source and configured to mix a treatment fluid with a plurality of proppant from the one or more proppant storage vessels; and one or more fluid pumps fluidically coupled to the blender and the well. In one or more embodiments described above, the pressurizable delivery manifold is installed in an equipment trailer or a mobile skid.

Another embodiment of the present disclosure is a method that includes: providing a pressurizable delivery manifold for use with a piping system at a well, wherein the pressurizable delivery manifold includes: a fluid line including a fluid inlet and a fluid outlet; an equalization line coupled to the fluid inlet using a first piping tee and coupled to the fluid outlet using a second piping tee; one or more pressure chambers coupled to the equalization line; for each of the one or more pressure chambers, a separate plug coupled to that pressure chamber; and for each of the one or more pressure chambers, a separate remote plug valve coupled to that pressure chamber and coupled to the fluid line; and loading one or more well stimulation materials into the pressurizable delivery manifold; pressurizing the piping system and the pressurizable delivery manifold; releasing one or more well stimulation materials into a treatment fluid to create a payload delivery treatment fluid; and injecting the payload delivery treatment fluid into the well.

In one or more embodiments described in the preceding paragraph, the well stimulation materials further includes a plurality of particulates surrounded by a degradable packaging. In one or more embodiments described above, the well stimulation materials further comprise a plurality of particulates without any packaging.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. In particular, every range of values (e.g., "from about a to about b," or, equivalently, "from approximately a to b," or, equivalently, "from approximately a-b") disclosed herein is to be understood as referring to the power set (the set of all subsets) of the respective range of values. The indefinite articles "a" or "an," as used in the claims, are defined herein to mean one or more than one of the element that it introduces. Also, the terms in the claims have their plain, ordinary meaning unless otherwise explicitly and clearly defined by the patentee.

What is claimed is:

1. A method comprising:

providing a pressurizable delivery manifold at a well site, wherein the pressurizable delivery manifold is continuously equalized with a piping system, and wherein the pressurizable delivery manifold comprises:

a fluid line comprising a fluid inlet and a fluid outlet;

an equalization line coupled to the fluid inlet via a first piping tee and coupled to the fluid outlet via a second piping tee;

one or more pressure chambers coupled to the equalization line;

for each of the one or more pressure chambers, a separate plug coupled to that pressure chamber; and for each of the one or more pressure chambers, a separate remote plug valve coupled to that pressure chamber and coupled to the fluid line;

providing a pressurized treatment fluid to the pressurizable delivery manifold;

releasing one or more well stimulation materials into the pressurized treatment fluid to create a payload delivery treatment fluid; and injecting the payload delivery treatment fluid into at least a portion of a subterranean formation.

2. The method of claim 1, wherein the payload delivery treatment fluid comprises a slurry.

3. The method of claim 1, further comprising:

loading the one or more well stimulation materials into the pressurizable delivery manifold; and pressurizing the piping system after loading the one or more well stimulation materials.

4. The method of claim 3, wherein loading of the one or more well stimulation materials into the pressurizable delivery manifold further comprises operating one or more plugs.

5. The method of claim 1, wherein releasing one or more well stimulation materials into the pressurized treatment fluid to create a payload delivery treatment fluid comprises operating one or more remote plug valves.

6. The method of claim 1, wherein the one or more well stimulation materials are selected from the group consisting of: natural sand; a manmade proppant, a manmade ceramic, sintered bauxite, a processed solid, a diverting agent, a flow constraint additive, a surfactant, a penetrating agent, a solvent, a formation mobility modifier, a polymer breaker, an acid, a base, a crosslinker, a biocide, a fibrous material, a viscosity additive, a friction reducer, and any combination thereof.

7. The method of claim 1, wherein the one or more well stimulation materials are selected from the group consisting of: a basalt (trap rock) aggregate, a polylactic acid, a polylactide resin, or any combination thereof.

8. The method of claim 1, wherein the one or more well stimulation materials further comprise a plurality of particulates surrounded by a degradable packaging.

9. The method of claim 8, wherein the degradable packaging comprises a polyvinyl alcohol.

10. The method of claim 8 further comprising allowing the degradable packaging to dissolve in the pressurized treatment fluid.

11. The method of claim 1, wherein the one or more well stimulation materials are different.

12. The method of claim 1, wherein releasing one or more well stimulation materials into the pressurized treatment fluid to create a payload delivery treatment fluid comprises remotely opening one or more remote plug valves and allowing the well stimulation materials to gravity feed into the pressurized treatment fluid.

13. A system comprising:

one or more fluid pumps;

a treatment fluid source fluidically coupled to the one or more fluid pumps;

a pressurizable delivery manifold fluidically coupled to the one or more fluid pumps, wherein the pressurizable delivery manifold comprises:

a fluid line comprising a fluid inlet and a fluid outlet;

an equalization line coupled to the fluid inlet using a first piping tee and coupled to the fluid outlet using a second piping tee;

one or more pressure chambers coupled to the equalization line;

for each of the one or more pressure chambers, a separate plug coupled to that pressure chamber; and for each of the one or more pressure chambers, a separate remote plug valve coupled to that pressure chamber and coupled to the fluid line.

14. The system of claim 13, wherein the pressurizable delivery manifold further comprises:

an equalization line fluidically coupled to the fluid inlet, fluid outlet, and the one or more pressure chambers; and a well bore fluidically coupled to the fluid outlet.

15. The system of claim 13, further comprising:

one or more proppant storage vessels;

a blender fluidically coupled to the treatment fluid source and configured to mix a treatment fluid with a plurality of proppant from the one or more proppant storage vessels; and one or more fluid pumps fluidically coupled to the blender and a well.

16. The system of claim 13, wherein the pressurizable delivery manifold is installed in an equipment trailer or a mobile skid.

17. A method comprising:

providing a pressurizable delivery manifold for use with a piping system at a well, wherein the pressurizable delivery manifold comprises:

a fluid line comprising a fluid inlet and a fluid outlet;

an equalization line coupled to the fluid inlet using a first piping tee and coupled to the fluid outlet using a second piping tee;

one or more pressure chambers coupled to the equalization line;

for each of the one or more pressure chambers, a separate plug coupled to that pressure chamber; and for each of the one or more pressure chambers, a separate remote plug valve coupled to that pressure chamber and coupled to the fluid line; and loading one or more well stimulation materials into the pressurizable delivery manifold;

pressurizing the piping system and the pressurizable delivery manifold;

releasing one or more well stimulation materials into a treatment fluid to create a payload delivery treatment fluid; and injecting the payload delivery treatment fluid into the well.

18. The method of claim 17, wherein the well stimulation materials further comprise a plurality of particulates surrounded by a degradable packaging.

19. The method of claim 17, wherein the well stimulation materials further comprise a plurality of particulates without any packaging.

* * * * *